US008302916B2

(12) United States Patent
Dembowiak et al.

(10) Patent No.: US 8,302,916 B2
(45) **Date of Patent: *Nov. 6, 2012**

(54) BAG SUPPORT WITH CINCHING MECHANISM

(75) Inventors: Casey M. Dembowiak, Greenfield, WI (US); Edmund A. Malczewski, Milwaukee, WI (US)

(73) Assignee: Riverwest Engineering & Design, Inc., West Allis, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/613,809

(22) Filed: Nov. 6, 2009

(65) Prior Publication Data

US 2010/0270441 A1 Oct. 28, 2010

Related U.S. Application Data

(63) Continuation of application No. 12/430,622, filed on Apr. 27, 2009.

(51) Int. Cl.
*B65B 67/12* (2006.01)

(52) U.S. Cl. ..... 248/95; 248/97; 248/99; 220/495.08; 232/43.2

(58) Field of Classification Search ..... 220/495.08; 232/43.2; 248/95, 97, 99; D34/1, 5
See application file for complete search history.

(56) References Cited

U.S. PATENT DOCUMENTS

| | | | | |
|---|---|---|---|---|
| 63,383 | A | | 4/1867 | Hanks |
| 100,123 | A | | 2/1870 | Crofoot |
| 102,616 | A | | 5/1870 | Sweigert |
| 447,686 | A | | 3/1891 | Holladay |
| 653,035 | A | | 7/1900 | Noble |
| 1,022,862 | A | | 4/1912 | McMillen |
| 2,100,235 | A | * | 11/1937 | Brown ..... 248/97 |
| 2,125,122 | A | | 7/1938 | Luigi |
| 2,421,221 | A | | 5/1947 | Rothe |
| 2,451,829 | A | * | 10/1948 | Hightower ..... 248/100 |
| 2,470,977 | A | | 5/1949 | Chidsey, Jr. |
| 3,204,866 | A | * | 9/1965 | Brighton et al. ..... 232/43.2 |
| 3,314,632 | A | | 4/1967 | Freuler |
| 3,402,848 | A | * | 9/1968 | Busey ..... 220/495.08 |
| 3,451,582 | A | | 6/1969 | Morgan |
| 3,502,291 | A | | 3/1970 | Ackerman et al. |
| 3,510,055 | A | * | 5/1970 | Safford ..... 232/43.2 |
| 3,556,396 | A | | 1/1971 | Herman |
| 3,633,932 | A | * | 1/1972 | Holden ..... 280/641 |
| 3,659,816 | A | | 5/1972 | Wilson |
| 3,866,824 | A | | 2/1975 | Lewis |
| 3,948,474 | A | | 4/1976 | Pomroy |
| 4,199,122 | A | | 4/1980 | Christie |
| 4,363,438 | A | | 12/1982 | Connor |
| 4,577,778 | A | | 3/1986 | Kim |
| 4,593,873 | A | | 6/1986 | Nelson |
| 4,613,104 | A | | 9/1986 | Garrott |
| 4,697,771 | A | | 10/1987 | Majors |
| 4,711,367 | A | | 12/1987 | Albertson |

(Continued)

*Primary Examiner* — Terrell McKinnon
*Assistant Examiner* — Daniel J Breslin
(74) *Attorney, Agent, or Firm* — Boyle Fredrickson, S.C.

(57) ABSTRACT

A bag support is provided for supporting the upper portion of a bag. The bag support includes first and second side rails generally parallel to each other. A first bag retainer is positioned between the first and second rails for receiving a first portion of an upper end of a first bag thereon. The first bag retainer pivotable between a first position and a second retaining position for supporting the first bag in an open configuration.

9 Claims, 9 Drawing Sheets

U.S. PATENT DOCUMENTS

| | | | | |
|---|---|---|---|---|
| 4,723,741 | A | | 2/1988 | Doering |
| 4,793,628 | A | | 12/1988 | Haley, Sr. |
| 4,834,262 | A | * | 5/1989 | Reed ..... 220/495.09 |
| 4,856,740 | A | * | 8/1989 | MacLeod et al. ..... 248/97 |
| D304,873 | S | | 11/1989 | Ruehland |
| 4,953,815 | A | | 9/1990 | Beymer et al. |
| 5,014,944 | A | * | 5/1991 | Malik et al. ..... 248/99 |
| 5,044,644 | A | | 9/1991 | Duran et al. |
| 5,072,852 | A | * | 12/1991 | Smith et al. ..... 220/495.09 |
| 5,076,458 | A | | 12/1991 | Weiner et al. |
| 5,203,618 | A | | 4/1993 | Oshall |
| D337,402 | S | | 7/1993 | Burelle |
| D352,581 | S | | 11/1994 | Fredericks |
| 5,360,189 | A | | 11/1994 | Hart |
| 5,390,813 | A | | 2/1995 | Anderson et al. |
| 5,398,838 | A | | 3/1995 | Dosunmu |
| D358,012 | S | | 5/1995 | Faulkner et al. |
| 5,411,229 | A | | 5/1995 | Hoefkes |
| 5,570,862 | A | | 11/1996 | Nugent |
| D388,922 | S | | 1/1998 | Peters |
| 5,799,908 | A | | 9/1998 | Downs |
| 5,819,974 | A | | 10/1998 | Caldwell |
| 5,873,643 | A | * | 2/1999 | Burgess et al. ..... 312/290 |
| 5,887,696 | A | | 3/1999 | Goetz |
| D423,168 | S | | 4/2000 | Studstill |
| 6,076,782 | A | | 6/2000 | Alderman |
| D428,229 | S | | 7/2000 | Olivetti |
| 6,116,549 | A | | 9/2000 | Santa Cruz et al. |
| 6,241,115 | B1 | | 6/2001 | Delmerico et al. |
| 6,334,593 | B2 | | 1/2002 | Inoue |
| 6,419,193 | B1 | * | 7/2002 | Rodriquez ..... 248/98 |
| 6,491,264 | B1 | * | 12/2002 | Valesquez ..... 248/97 |
| 6,550,792 | B1 | | 4/2003 | Getz et al. |
| D481,509 | S | | 10/2003 | Perelli |
| 6,676,141 | B1 | | 1/2004 | Hadley |
| D507,089 | S | | 7/2005 | Enayati et al. |
| 7,032,868 | B2 | | 4/2006 | Mutert |
| D521,204 | S | | 5/2006 | Lauer |
| D531,373 | S | | 10/2006 | DesLaurier |
| 7,188,745 | B2 | | 3/2007 | Schermel |
| D546,521 | S | | 7/2007 | Mutert |
| D550,980 | S | * | 9/2007 | Dixon ..... D6/396 |
| D552,320 | S | | 10/2007 | Presnell et al. |
| 7,290,674 | B1 | * | 11/2007 | Ledford ..... 220/507 |
| 7,624,915 | B2 | * | 12/2009 | Dembowiak et al. ..... 232/43.2 |
| 2006/0196879 | A1 | | 9/2006 | Chochinov et al. |
| 2007/0164173 | A1 | * | 7/2007 | Li ..... 248/97 |
| 2009/0194540 | A1 | * | 8/2009 | Dembowiak et al. .... 220/495.06 |
| 2009/0194579 | A1 | * | 8/2009 | Dembowiak et al. ..... 232/43.2 |

* cited by examiner

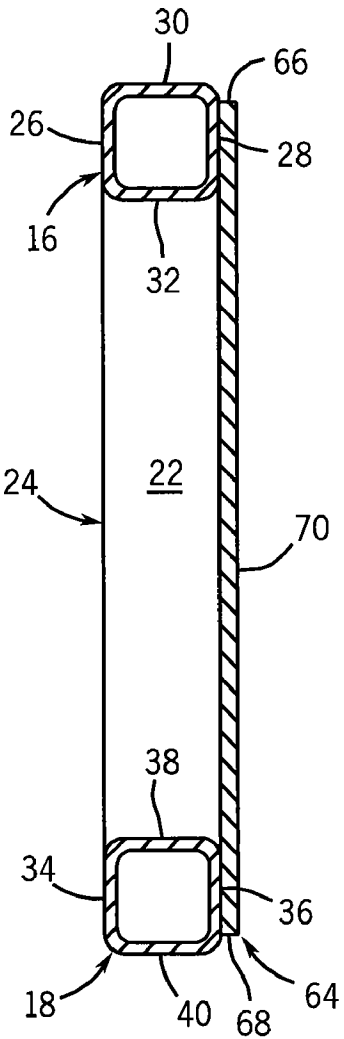
11
FIG. 1C
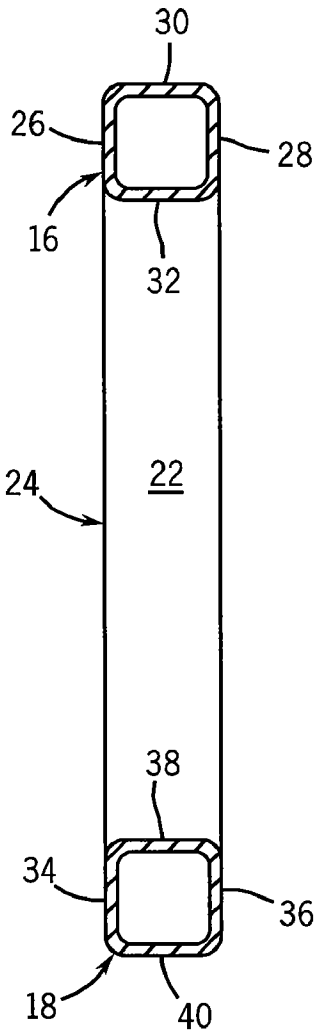

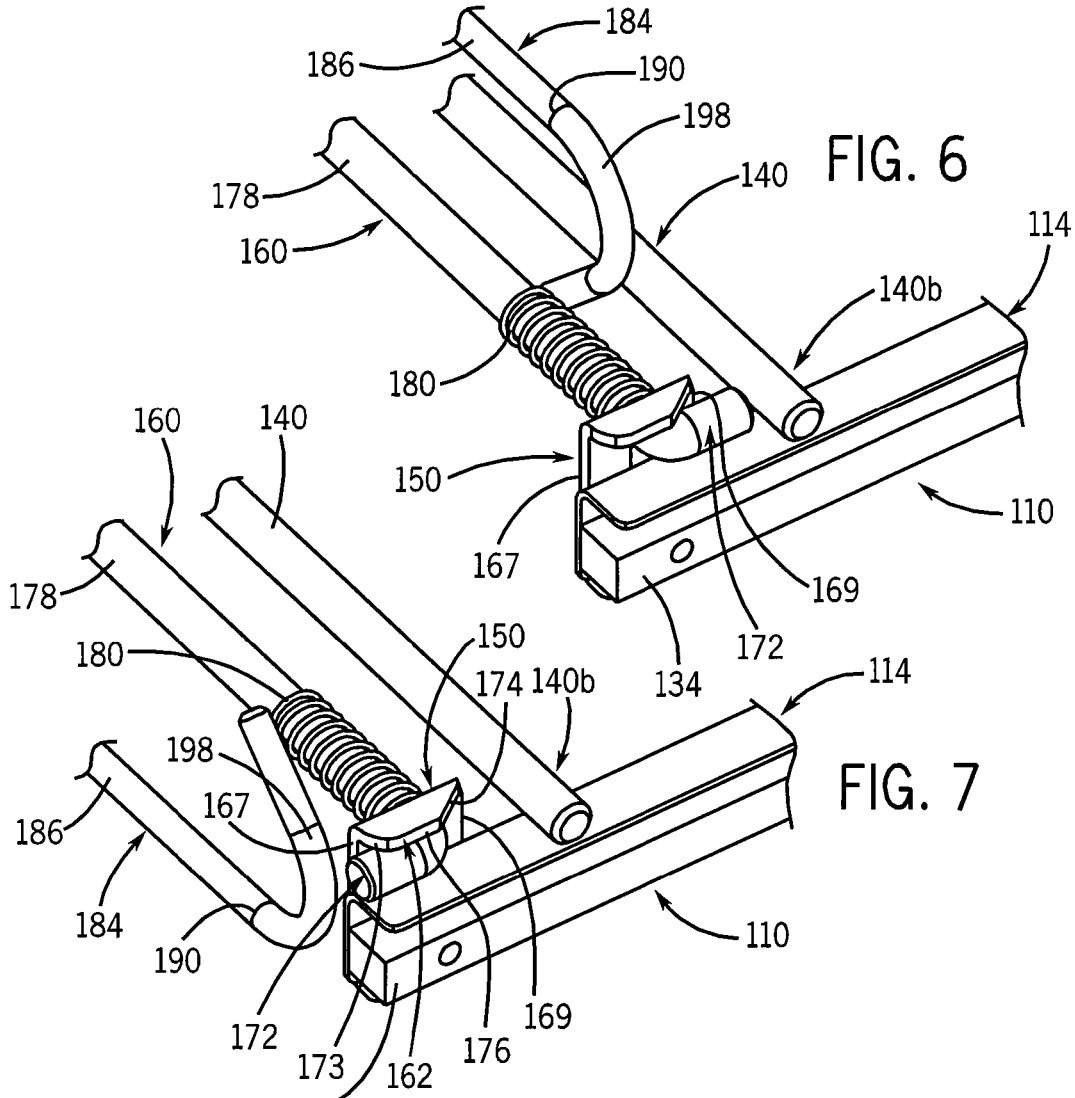
FIG. 6
FIG. 7
FIG. 8
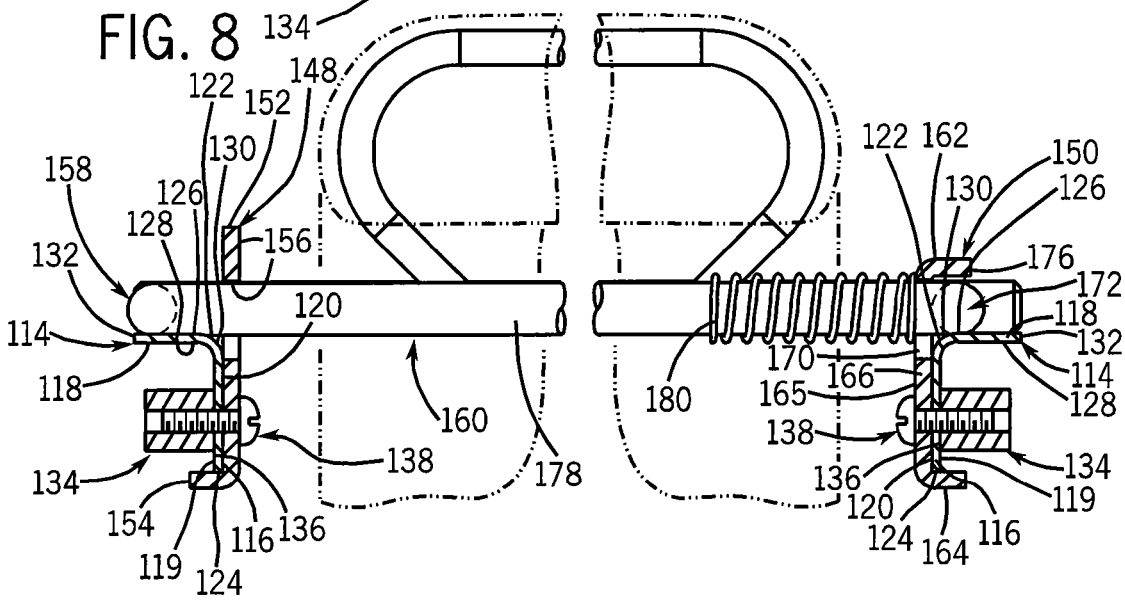

204
208
184
160
140
142
149
110
82b 204
208
160
140
142
149
110
82b 204
208
160
140
142
149
110
82b

BAG SUPPORT WITH CINCHING MECHANISM

CROSS-REFERENCE TO RELATED APPLICATIONS

This application is a continuation of application Ser. No. 12/430,622, entitled "Recycling Center," and filed Apr. 27, 2009.

FIELD OF THE INVENTION

This invention relates generally to containers, and in particular, to a cinching mechanism for a bag support of a modular recycling center that retains one or more bags in an open configuration therein.

BACKGROUND AND SUMMARY OF THE INVENTION

As is known, the United States produces over 250 million tons of municipal solid waste each year. This number represents approximately 4.6 pounds of waste per person per day. A large portion of this waste is hauled away in garbage trucks and packed into sanitary landfills. As a result, landfilling has become the number one method of disposing trash in the United States. However, most of the material disposed of in landfills is recyclable. Hence, in order to reduce the volume of waste disposed of in landfills, Americans have turned to recycling. It has be found that recycling benefits the environment at every stage in the life cycle of a consumer product, from the raw material used to make the product, to the final method of disposal. In order to encourage recycling, many public facilities have start to position recycling bins throughout their premises.

While functional for their intended purpose, these prior recycling bins have shortcomings that make them unsuitable for certain applications. For example, prior recycling bins typically have single openings for receiving single types of recycling material therein. As such, a user must provide distinct recycling bins for each type of recycling material. In other words, a first recycling bin may be provided for receiving a first material such as paper and a second recycling bin may be provided for receiving a second material such as plastic. This, in turn, increases the overall costs associated with providing recycle bins in certain environments.

In addition, prior recycling bins require the use of bags therein. These bags receiving the recycling materials deposited in the recycling bins. Consequently, these bags must be replaced after each bag is filled with recycling material. As such, it is highly desirable to provide a simple and easy mechanism for attaching and supporting the bag within a corresponding recycle bin. In addition, a bag filled with recycling material may weight a significant amount. It is also highly desirable to provide a mechanism for maintaining the bag in an open configuration within a corresponding recycle bin as the bag is filled.

Sholinder, U.S. Pat. No. 7,198,166 discloses an example of a prior recycling bin. The bin discloses in the '166 patent includes a rigid modular container having a floor and an opposite lid. Opposite rigid rectilinearly-shaped first and second panels are provided between the floor and lid and oppositely disposed rigid rectilinearly-shaped third and fourth panels extending from and between the first and second panels. The panels are removably mounted to the floor. The side edges of adjacent panels are removably mounted to each other as by bolting so that the side edges of the third and fourth panels abut the side edges of the first and second panels. Fastener bracing means such as bolt bracing are mounted to the side edges of the panels and are aligned between adjacent the panels so that fastener receiving apertures therethrough provide for rigid bracing of rigid fasteners such as bolts mounted through and between the fastener bracing means on the adjacent panels. Rigid fasteners such as bolts may be mounted through the fastener bracing means on the adjacent the panels. It is noted, however, that no mechanism is provided for supporting one or bags within the recycling bin. Further, the '166 patent does not contemplated providing a bin having multiple openings therein which are adapted receiving different types of recycling material.

Therefore, it is a primary object and feature of the present invention to provide a cinching mechanism for a bag support of a modular recycling center that retains one or more bags in an open configuration therein.

It is a further object and feature of the present invention to provide a cinching mechanism for a bag support of a modular recycling center that is simple to use.

In accordance with the present invention, a bag support is provide for supporting the upper portion of a bag. The bag support includes first and second side rails generally parallel to each other. A first bag retainer is positioned between the first and second rails for receiving a first portion of an upper end of a first bag thereon. The first bag retainer is pivotable between a first position and a second retaining position for supporting the first bag in an open configuration.

A first rod extends between the first and second rails along a first axis. A second rod extends between the first and second rails along a second axis. A second bag retainer may be mounted to the second rod for receiving a second portion of the upper end of the first bag thereon. Alternatively, a second bag retainer may be positioned between the first and second rails for receiving a first portion of an upper end of a second bag thereon. The second bag retainer is pivotable between a first position and a second retaining position for supporting the second bag in an open configuration. I is contemplated for the first bag retainer to define a loop. In addition, the first bag retainer may be movable along the first axis between a first retaining position wherein the first bag retainer is maintained in a user desired position and a second position wherein the first bag retainer is movable between the first and second positions.

In accordance with a further aspect of the present invention, a bag support is provided. The bag support includes a first bar extending along a first axis. A first bag retainer extends therefrom. The first bag retainer is pivotable between a first position and a second retaining position for supporting a first bag in an open configuration. A second bar extends along a second axis generally parallel to the first axis and includes a first bag retainer extending therefrom. The first bag retainer of the second bar supports the upper portion of the corresponding bag.

A second bag retainer may extend from the first bar for receiving a first portion of an upper end of a second bag thereon. The second bag retainer is pivotable between a first position and a second retaining position for supporting the second bag in an open configuration. A second bag retainer extends from the second bar for receiving a second portion of the upper end of the second bag thereon.

First and second rails extend between the first and second bars. The first bar is movable along the first axis between a first retaining position wherein the first bag retainer is maintained in a user desired position and a second position wherein the first bag retainer is movable between the first and second positions.

In accordance with a still further aspect of the present invention, a bag support is provided. The bag support includes a first bar extending along a first axis and a second bar extending along a second axis generally parallel to the first axis. A first support has a first end operatively connected to the first bar and a second end operatively connected to the second bar. A first bag retainer extends from the first bar for receiving a first portion of an upper end of a first bag thereon. The first bar is pivotable such that first bag retainer moves between a first position and a second retaining position for supporting the first bag in an open configuration.

A second bag retainer extends from the first bar for receiving a first portion of an upper end of a second bag thereon. The second bag retainer is movable between a first position and a second retaining position for supporting the second bag in an open configuration. A second support extends between the first and second bars along a second axis. A second bag retainer also extends from the second bar for receiving a second portion of the upper end of the first bag thereon. The first bar is movable along the first axis between a first retaining position wherein the first bag retainer is maintained in a user desired position and a second position wherein the first bar is pivotable. A biasing structure is provided for urging the first bar towards the retaining position. It is contemplated for a first end of the first bag retainer to be generally C-shaped and a second end of the first retainer to be generally C-shaped. The first bag retainer extending from the first bar is one of a plurality of bag retainers extending from the first bar.

BRIEF DESCRIPTION OF THE DRAWINGS

The drawings furnished herewith illustrate a preferred construction of the present invention in which the above advantages and features are clearly disclosed as well as other which will be readily understood from the following description of the illustrated embodiment.

In the drawings:

FIG. 1C is a cross-sectional view of the recycling center of the present invention taken along line 1C-1C of FIG. 1B;

FIG. 6 is an enlarged, isometric view of the cinching mechanism for the bag holding slide for the recycling center of the present invention with the cinching mechanism in the non-cinching position;

FIG. 7 is an enlarged, isometric view of the cinching mechanism for the bag holding slide for the recycling center of the present invention with the cinching mechanism in the cinching position;

FIG. 8 is a cross-sectional view of the bag holding slide for the recycling center of the present invention taken along line 8-8 of FIG. 3;

DETAILED DESCRIPTION OF THE DRAWINGS

Figure 1:
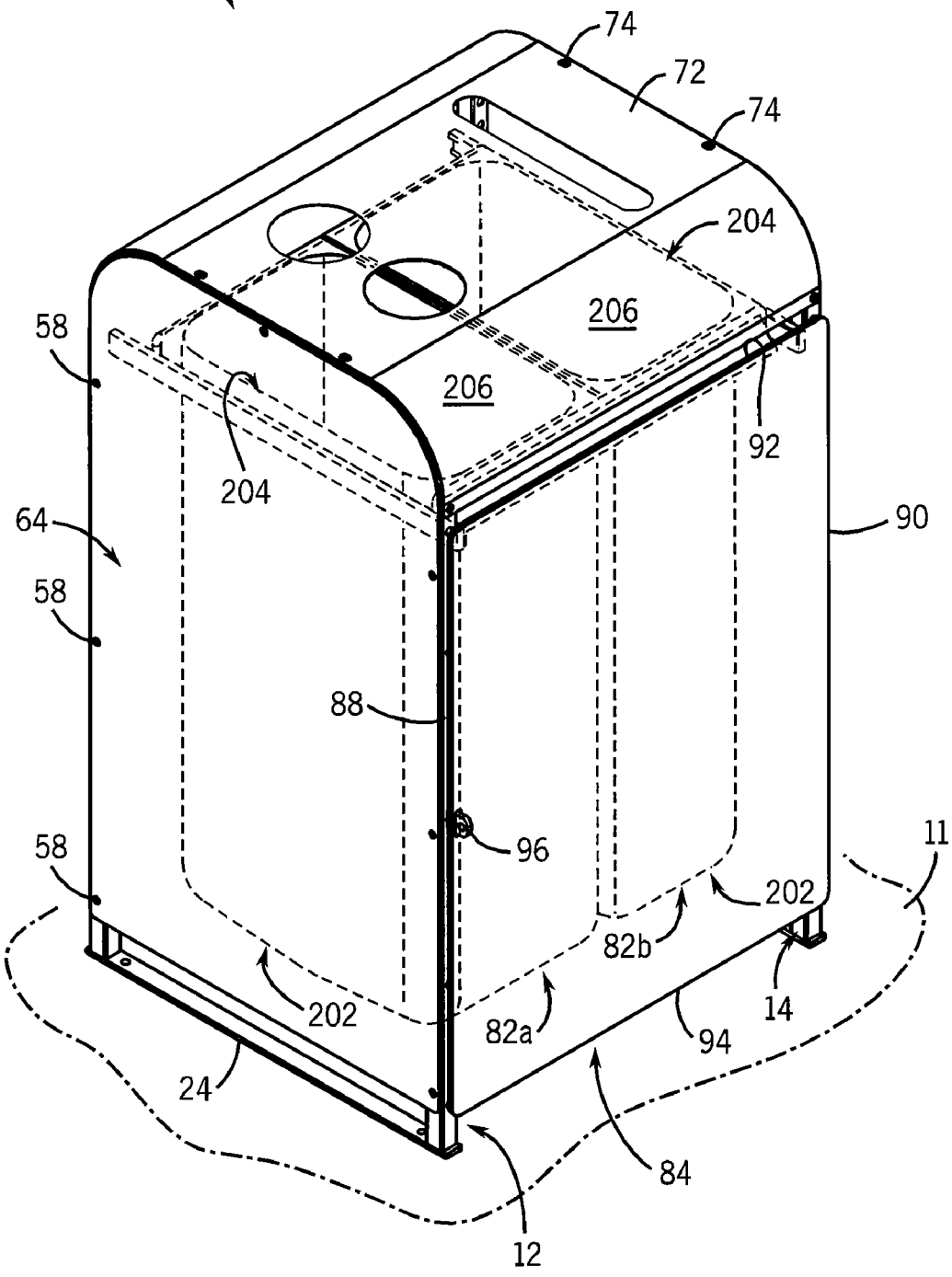
FIG. 1 is an isometric view of a recycling center in accordance with the present invention.

Referring to FIG. 1, a recycling center in accordance with the present invention is generally designated by the reference numeral 10. As hereinafter described, it is intended for the recycling center 10 to be supported on a supporting surface 11 and to house bag(s) or the like for receiving recyclable materials therein. Recycling center 10 includes first and second generally U-shaped frame members 12 and 14, respectfully. It is noted that first and second frame members 12 and 14 are identical in structure. As such, the description hereinafter of first frame member 12 is understood to describe second frame member 14 as if fully described herein.

Figure 1B:
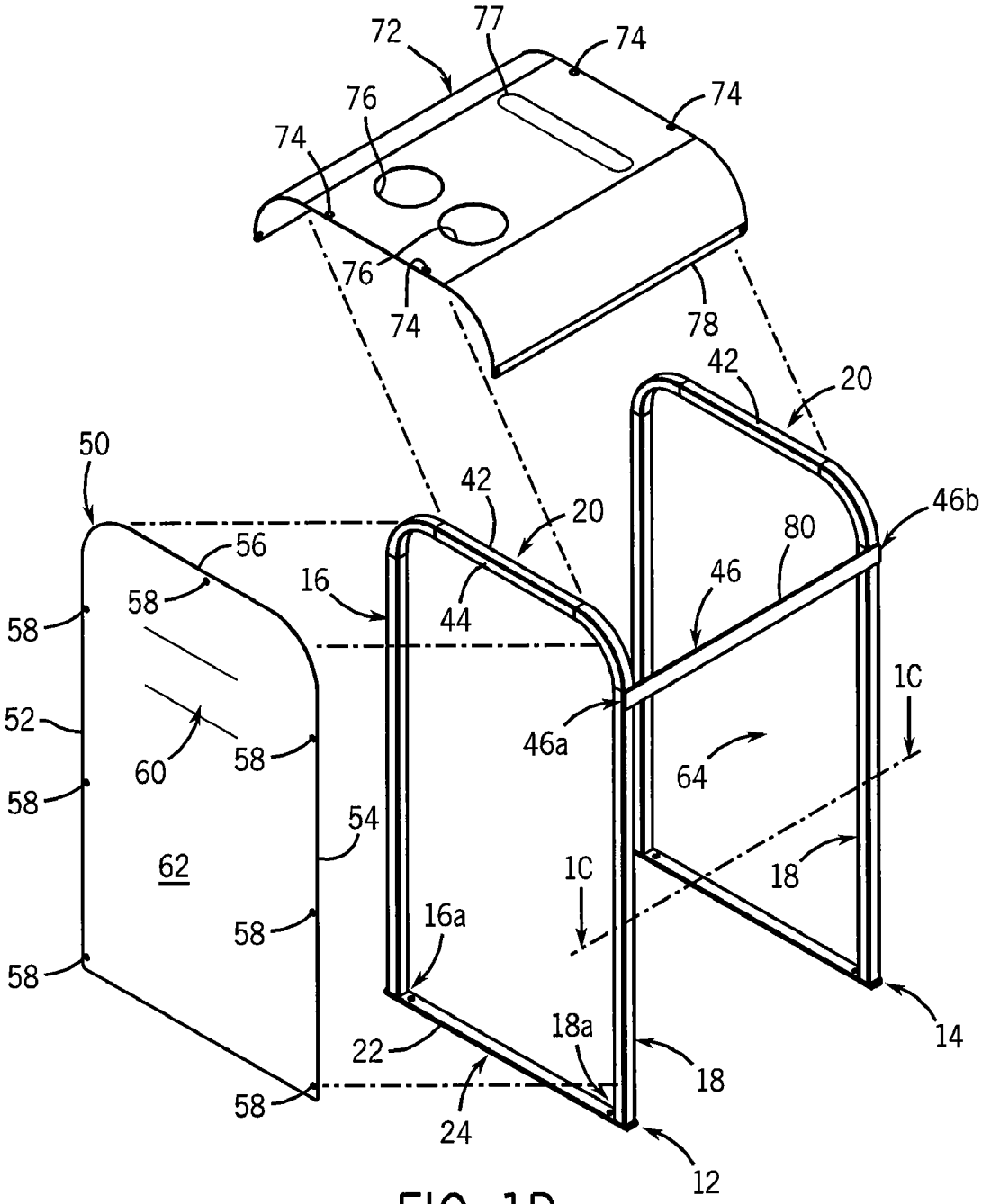
FIG. 1B is an exploded view of a portion of the recycling center of FIG. 1.

First frame member 12 is generally U-shaped and has a generally square cross section. As best seen in FIGS. 1B and 1C, first frame member 12 is defined by first and second spaced legs 16 and 18, respectfully. Upper ends of first and second legs 16 and 18, respectfully, of first frame member 12 are interconnected by upper cross leg 20. First and second legs 16 and 18 terminate at generally flat lower ends 16*a* and 18*a*, respectfully. Lower ends 16*a* and 18*a* of first and second legs 16 and 18, respectfully, of first frame member 12 are positioned on and interconnected to upper surface 22 of generally flat lower frame member 24.

First leg 16 of first frame member 12 includes a generally parallel inner and outer faces 26 and 28, respectively, interconnected by generally parallel sides 30 and 32, respectfully. Second leg 18 of first frame member 12 also includes inner and outer faces 34 and 36, respectively. Outer face 36 of second leg 18 of first frame member 12 lies in a common plane with outer face 28 of first leg 16 of first frame member 12. Inner and outer faces 34 and 36, respectively, of second leg 18 of first frame member 12 are interconnected by first and second generally parallel, spaced sides 38 and 40, respectively. Sides 30 and 40 of first and second legs 16 and 18, respectively, of first frame member 12 are interconnected by upper surface 42 of upper cross leg 20. Outer faces 28 and 36 of first and second legs 16 and 18, respectively, of first frame member 12 are interconnected by generally flat outer face 44 of cross leg 20.

First and second frame members 12 and 14, respectively, are interconnected by forward cross frame support 46. Forward cross frame support 46 includes a first end 46*a* affixed to side 40 of second leg 18 of first frame member 12 and a second end 46*b* affixed to side 40 of second leg 18 of second frame member 14. It is further contemplated to interconnect first legs 16 of first and second frame members 12 and 14, respectively, to add strength and rigidity to recycling center 10.

First panel 50 is interconnected to outer faces 28 and 36 of first and second legs 16 and 18, respectively, of first frame member 12 and to outer face 44 of upper cross leg 20 of first frame member 12. First panel 50 includes a first edge 52 aligned with side 30 of first leg 16 of first frame member 12; a second edge 54 aligned with side 40 of second leg 18 of first frame member 12; and upper edge 56 aligned with upper face 42 of upper cross leg 20 of first frame member 12. It is contemplated to interconnect first panel 50 to first frame member 20 with a plurality of spaced fasteners 58 such as rivets, screws, bolts or the like. It is further contemplated to provide indicia 16 on outer surface 62 of first panel 50 so as to allow a user to identify recycling center 10, as desired.

Second panel 64 is attached to outer faces 28 and 36 of first and second legs 16 and 18, respectively, of second frame member 14 and to outer face 44 of upper cross leg 20 of second frame member 18 by a plurality of spaced fasteners 58. Edge 66 of second panel 64 is aligned with outer face 30 of first leg 16 of second frame member 18; edge 68 of panel 64 is aligned with side 40 of second leg 18 of second frame member 14; and the upper edge of panel 64 is aligned with upper face 42 of upper cross leg 20 of second frame member 14. Outer surface 70 of second panel 64 may include indicia (not shown) to allow a user to identify recycling center 10, as desired.

Recycling center 10 may also include an optional rear panel (not shown) interconnected to first legs 16 of first and second frame members 12 and 14, respectively. In addition, recycling center 10 includes an upper panel 72 positioned on and interconnected to upper faces 42 of upper cross legs 20 of first and second frame members 12 and 14, respectively, by a plurality of fasteners 74 such as screws, bolts, and/or rivets. Generally circular apertures 76 extend through upper panel 72, for reasons hereinafter described. Similarly, a second oblong aperture 77 extends through upper panel 72, for reasons hereinafter described. With upper panel 72 positioned on first and second frame members 12 and 14, respectively, forward edge 78 of upper panel 76 is adjacent upper edge 80 of forward cross support 46. As hereinafter described, upper panel 72 and first and second side panels 50 and 64, respectively, define a chamber for receiving one or more conventional bags 82*a*, 82*b* therein, as hereinafter described.

Figure 2:
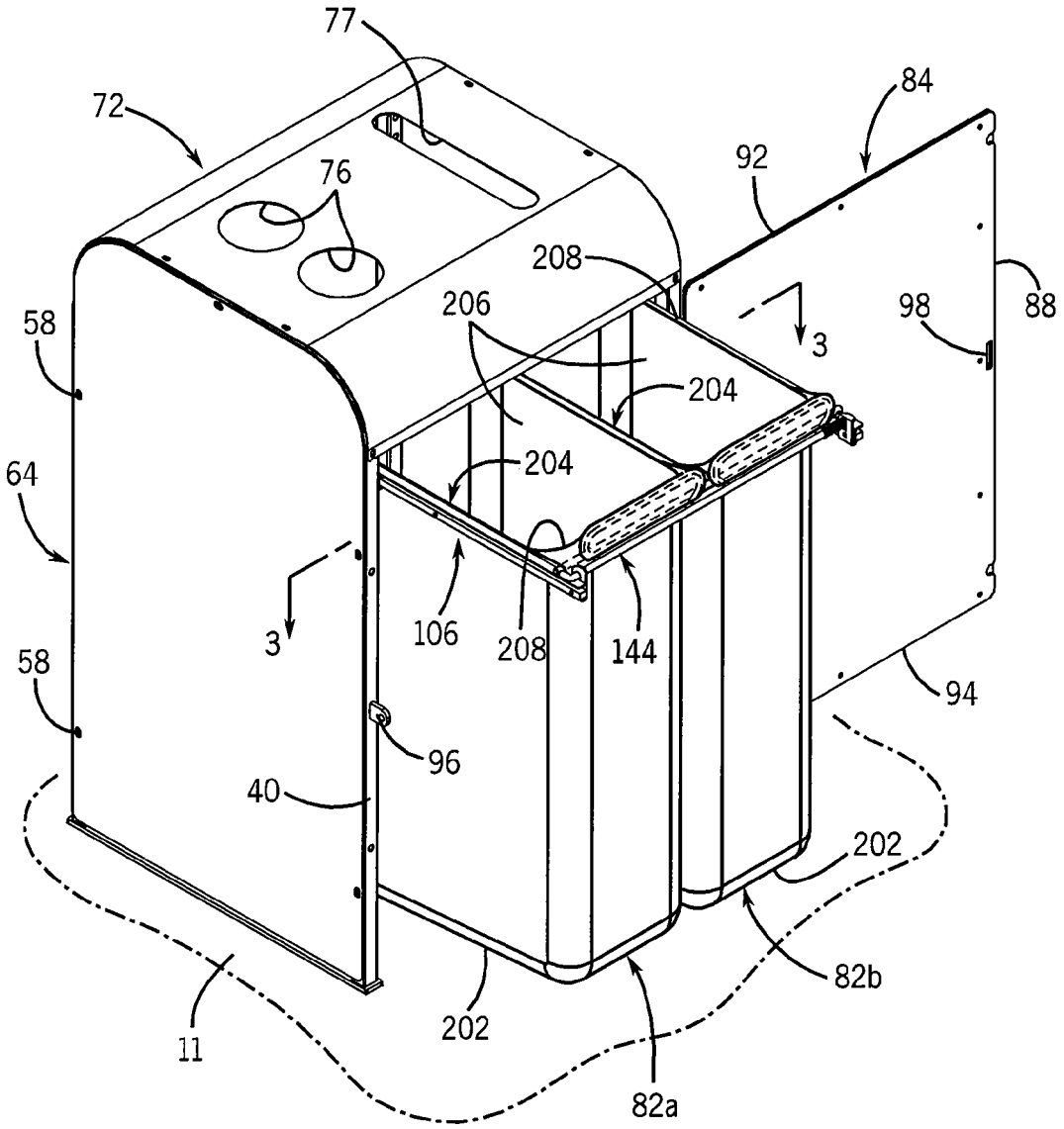
FIG. 2 is an isometric view of the recycling center of the present invention with the door of the recycling center in the open position.
Figure 3:
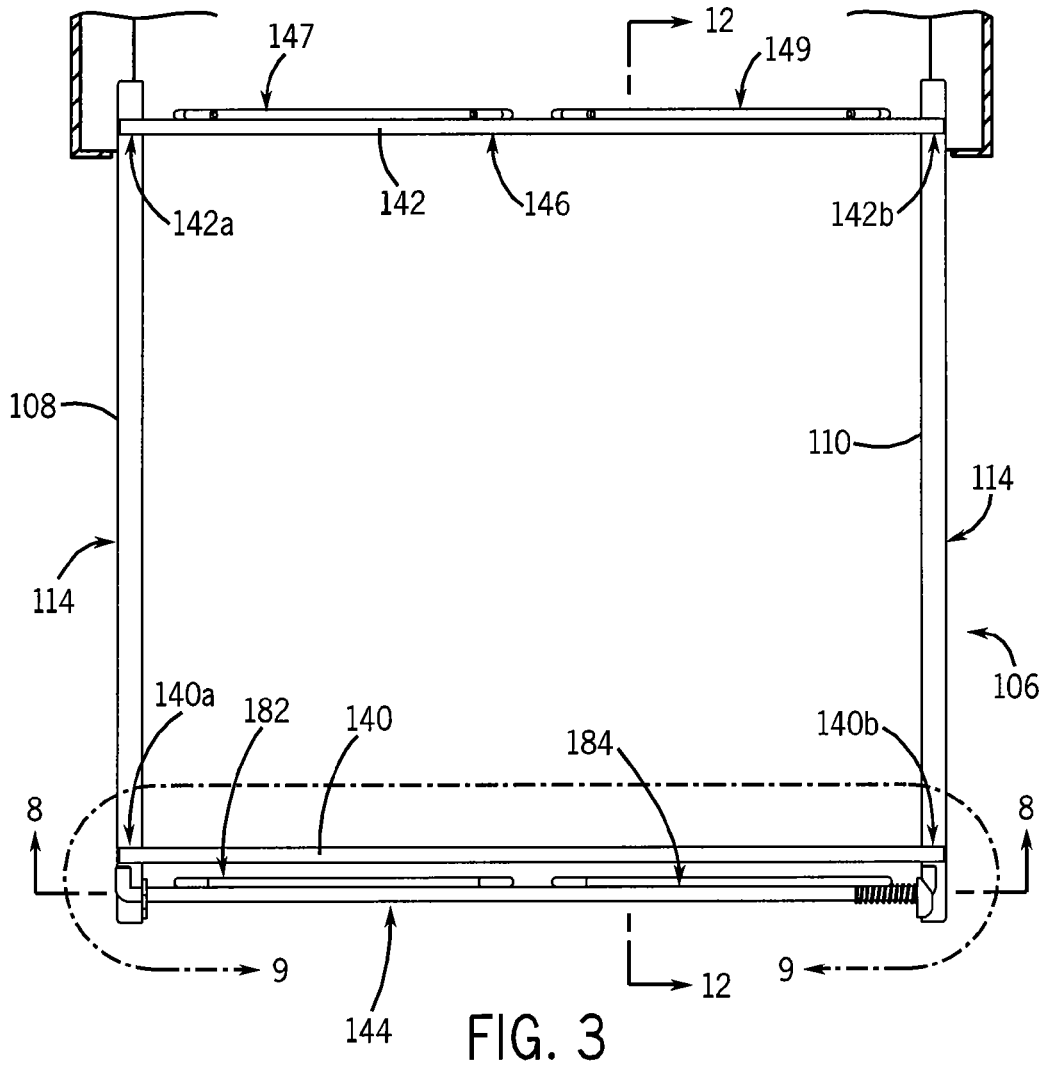
FIG. 3 is a cross-sectional view of the recycling center of the present invention taken along line 3-3 of FIG. 2.

Recycling center 10 further includes door 84 to provide access to the chamber therein. Door 84 is defined by a generally flat panel having first and second sides 88 and 90, respectively, interconnected by upper and lower ends 92 and 94, respectively. Side 90 of door 84 is interconnected to side 40 of second leg 18 of second frame member 14 by one or more hinges so as to allow door 84 to pivot between a closed position, FIG. 1, and an open position, FIG. 2. In order to maintain door 84 in a closed position, locking eye 96 may project from side 40 of second leg 18 of first frame element 12. Locking eye 96 is aligned with a corresponding slot 98 in door 84 such that with door 84 in the closed position, locking eye 96 projects through slot 98 in door 84. A locking bar of a conventional pad lock may be inserted through locking eye 96 to retain door 84 in its closed position.

Referring generally to FIGS. 2-14, first and second bags 82*a* and 82*b* are supported by bag slide 106. Bag slide 106 includes first and second side rails 108 and 110, respectively. Each side rail 108 and 110 includes generally L-shaped brackets 114, FIG. 8, defined by vertical and horizontal legs 116 and 118 respectively. Each vertical leg 116 is defined by inner and outer sides 119 and 120, respectively, and upper and lower edges 122 and 124, respectively. Horizontal legs 118 extend from upper edges 122 of corresponding vertical legs 116. Each horizontal leg 118 is defined by upper and lower sides 126 and 128, respectively, and inner and outer edges 130 and 132, respectively. Inner edges 130 of horizontal legs 118 intersect upper edges 122 of corresponding vertical legs 116. Each side rail 108 and 110 further includes guide members 134 secured to inner sides 119 of vertical legs 116 of brackets 114. Guide members 134 have a generally square cross section and include inner surfaces 136 positioned against corresponding inner sides 119 of vertical legs 116. Bolts 138 extend through vertical legs 116 and into guide members 134 secure guide members 134 to brackets 114.

Guide member 134 of first side rail 108 is telescopically and slidably received within a support bracket (not shown) mounted to inner faces 26 and 34 of first and second legs 16 and 18, respectively, of first frame member 12 adjacent the upper ends of first and second legs 16 and 18, respectively. Guide member 134 of second side rail 110 is similarly telescopically and slidably received within a support bracket (not shown) mounted to inner faces 26 and 34 of first and second legs 16 and 18, respectively, of second frame member 18 adjacent the upper ends of first and second legs 16 and 18, respectively. As described, first and second slide rails 108 and 110, respectively, and hence bag slide 106, is slidable between a retracted position, FIG. 1, wherein bag slide 106 is received entirely within the interior of the chamber defined by recycling center 10 and an extended position, FIG. 2, wherein bag slide 106 projects from the chamber within recycling center 10.

Brackets 114 of first and second side rails 108 and 110, respectively, are interconnected by forward rod 140 to add strength and stability to bag slide 106. Forward rod 140 includes a first end 140*a* affixed to upper side 126 of horizontal leg 118 of bracket 114 of first side rail 108 and a second end 140*b* affixed to upper side 126 of horizontal leg 118 of bracket 114 of second side rail 110.

Bag slide 106 further includes forward and rear bag supports 144 and 146, respectively. Rear bag support 146 includes rear rod 142 having a first end 142*a* affixed to upper side 126 of horizontal leg 118 of bracket 114 of first side rail 108 and a second end 142*b* affixed to upper side 126 of horizontal leg 118 of bracket 114 of second side rail 110. Rear bag support 146 further includes first and second bag retainers 147 and 149, respectively, depending from rear rod 142 at an acute angle to supporting surface 11 and lying in a common plane with each other, FIGS. 4-5. First bag retainer 147 is positioned adjacent first end 142*a* of rear rod 142 and second bag retainer 149 is positioned adjacent second end 142*b* of rear rod 142. Each bag retainer 147 and 149 is identical in structure. As such, the description of first bag retainer 147 is understood to describe second bad retainer 149 as if fully described herein. Bag retainer 147 includes bar 151 extending along a longitudinal axis generally parallel to rear rod 146 and having first and second opposite ends 153 and 155, respectively. First end 152 of bar 151 is interconnected to rear rod 142 by a first, generally arcuate, concave portion 157. Second end 155 of bar 151 is interconnected to rear rod 142 by a second, generally arcuate, concave portion 159.

Forward bag support 144 includes first and second mounts 148 and 150, respectively. First mount 148 is generally L-shaped and is defined by a first vertical leg 152 and a second horizontal leg 154. Horizontal leg 154 extends below lower edge 124 of vertical leg 116 of bracket 114 of first side rail 108. Vertical leg 152 is attached to bracket 114 of first side rail 108 by bolt 138 such that inner face 156 of vertical leg 152 is positioned against outer side 120 of vertical leg 116 of bracket 114 of first side rail 108. Vertical leg 152 further includes aperture 156 therethrough for receiving first end 158 of bag support rod 160, as hereinafter described. Bushings (not shown) may be positioned on one or both sides of vertical leg 152 to facilitate rotation of bag support rod 160 in aperture 156.

Second mount 150 of forward bag support 144 is generally U-shaped and is defined by upper and lower horizontal legs 162 and 164, respectively, interconnected by vertical leg 166. Lower horizontal leg 154 extends below lower edge 124 of vertical leg 116 of bracket 114 of second side rail 110. Vertical leg 166 of second mount 150 is attached to bracket 114 of second side rail 110 by bolt 138 such that inner face 168 of vertical leg 166 is positioned against outer side 120 of vertical leg 116 of bracket 114 of second side rail 110. Vertical leg 166 of second mount 150 is defined by first and second generally parallel edges 167 and 169 and further includes aperture 170 therethrough for receiving second end 172 of bag support rod 160, as hereinafter described. It is contemplated to provide bushings (not shown) on one or both sides of vertical leg 166 to facilitate rotation of bag support rod 160 in aperture 170. Upper horizontal leg 162 of second mount 150 extends laterally from the upper edge of vertical leg 166 so as to partially overlap horizontal leg 118 of bracket 114 of second side rail 110. Upper horizontal leg 164 of second mount 150 is defined by a generally arcuate edge 173 extending from first edge 167 of vertical leg 166; an angled edge 174 extending from second edge 169 of vertical leg 166 at an acute angle to the upper edge of vertical leg 166; and a terminal end 176 interconnecting arcuate edge 173 and angled edge 174.

Bag support rod 160 includes a central portion 178 extending along an axis. First and second ends 158 and 172, respectively, of bag support rod 160 are generally parallel to each other and project from opposite ends of central portion 178 along axes generally perpendicular to the axis of central portion 178. First and second ends 158 and 172, respectively, of bag support rod 160 extend through corresponding apertures 156 and 170 of first and second mounts 148 and 150, respectively, such that first and second mounts 148 and 150, respectively, rotatably support bag support rod 160. Spring 180 extends about central portion 178 of bag support rod 160 and abuts outer face 165 of vertical leg 166 of second mount 150 so as to urge bag support rod 160 from right to left in FIG. 8.

Forward bag support 144 further includes first and second bag retainers 182 and 184, respectively, projecting from bag support rod 160 and lying in a common plane, FIGS. 9-14. It is intended for first bag retainer 182 of forward bag support 144 to be aligned with first bag retainer 147 of rear bag support 146 and for second bag retainer 184 of forward bag support 144 to be aligned with second bag retainer 149 of rear bag support 146. More specifically, first bag retainer 182 is positioned adjacent first end 158 of bag support rod 160 and second bag retainer 184 is positioned adjacent second end 172 of bag support rod 160. Each bag retainer 182 and 184 is identical in structure. As such, the description of first bag retainer 182 is understood to describe second bad retainer 184 as if fully described herein. Bag retainer 182 includes bar 186 extending along a longitudinal axis and having first and second opposite ends 188 and 190, respectively. Bar 186 is generally parallel to bag support rod 160. First end 188 of bar 186 is interconnected to bag support rod 160 by a first, generally arcuate, concave portion 196. Second end 190 of bar 186 is interconnected to bag support rod 160 by a second, generally arcuate, concave portion 198.

Figures 9, 10, 11:
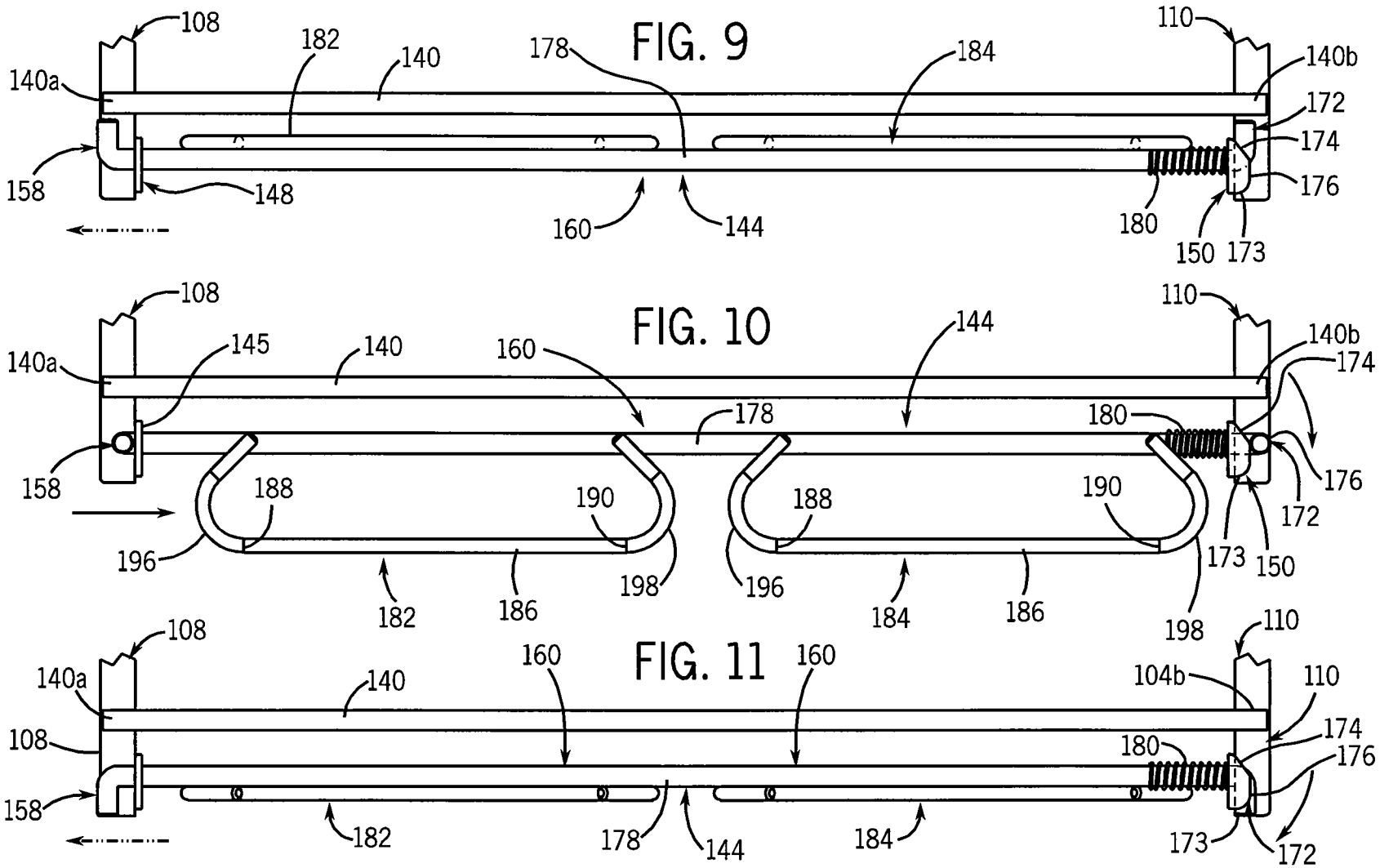
FIG. 9 is a top plan view of the cinching mechanism for the bag holding slide for the recycling center of the present invention with the cinching mechanism in the non-cinching position.
FIG. 10 is a top plan view of the cinching mechanism for the bag holding slide for the recycling center of the present invention with the cinching mechanism in an intermediate position.
FIG. 11 is a top plan view of the cinching mechanism for the bag holding slide for the recycling center of the present invention with the cinching mechanism in the cinching position.
Figures 12, 13, 14:
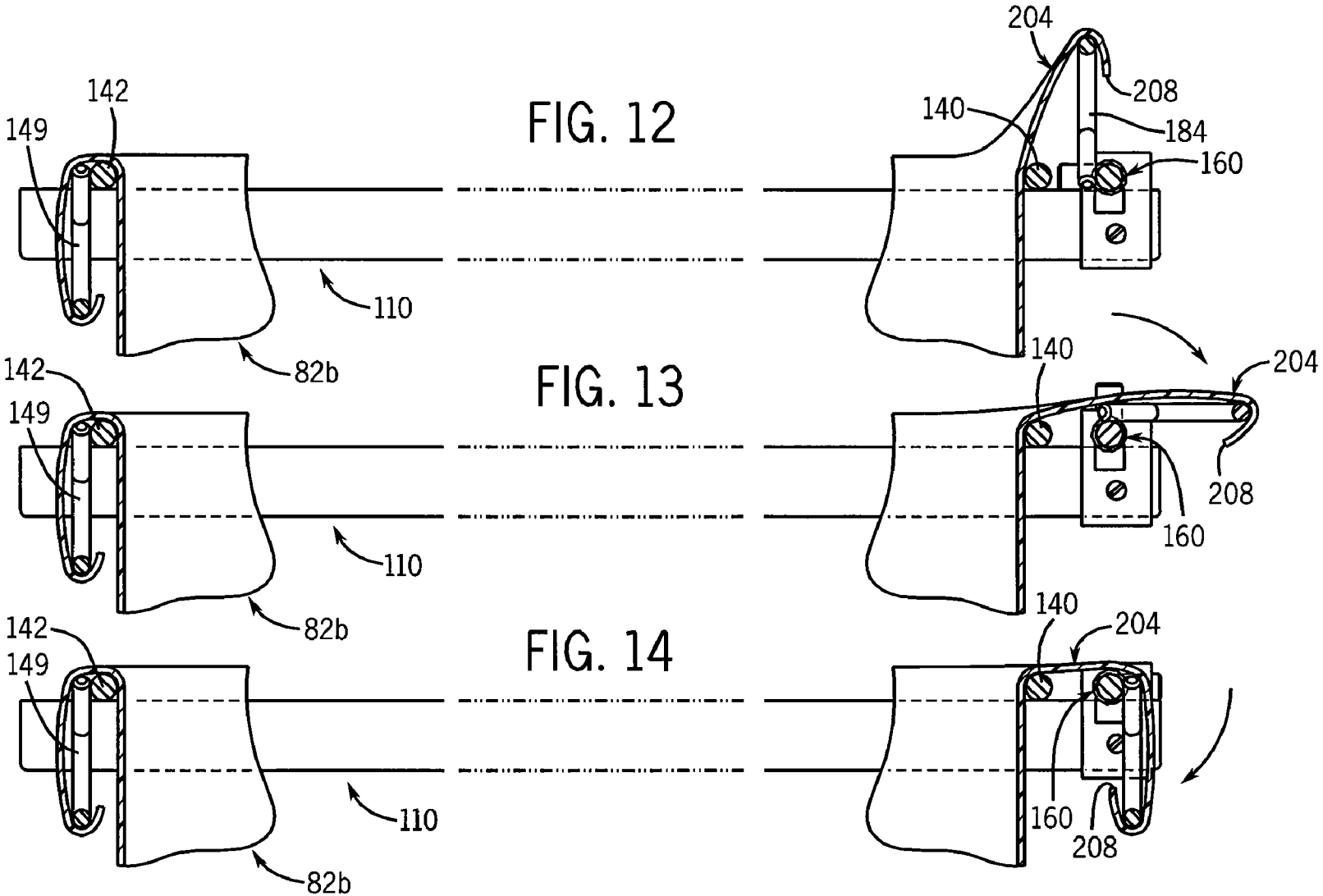
FIG. 12 is a side elevational view of the cinching mechanism for the bag holding slide for the recycling center of the present invention with the cinching mechanism in the non-cinching position.
FIG. 13 is a side elevational view of the cinching mechanism for the bag holding slide for the recycling center of the present invention with the cinching mechanism in an intermediate position.
FIG. 14 is a side elevational view of the cinching mechanism for the bag holding slide for the recycling center of the present invention with the cinching mechanism in the cinching position.

As described, forward bag support 144 is rotatable between a first, bag release position, FIGS. 6, 9 and 12, for mounting or removing conventional bags 82*a*, 82*b* therefrom and a second, bag retaining position, FIGS. 7, 11 and 14, for retaining bags 82*a*, 82*b* thereon. More specifically, with forward bag support 144 in the first, bag release position, second end 172 of bag support rod 160 is positioned between angled edge 174 of horizontal leg 164 of second mount 150 and horizontal leg 118 of bracket 114 and is biased against inner face 168 of vertical leg 166 of second mount 150 by spring 180, FIGS. 9-12. As forward bag support 144 is rotated counter-clockwise in FIGS. 4-7, second end 172 of bag support rod 160 engages angled edge 174 of horizontal leg 164 of second mount 150 and is moved from left to right in FIG. 8 against the bias of spring 180. Thereafter, second end 172 of bag support rod 160 engages and slides along terminal end 176 of horizontal leg 164 of second mount 150 against the bias of spring 180, FIGS. 10-13. As forward bag support 144 continues being rotated counter-clockwise in FIGS. 4-7, second end 172 of bag support rod 160 engages and slides along arcuate edge 173 of horizontal leg 164 of second mount 150, FIGS. 11 and 14. It can be appreciated that spring 180 urges bag support rod 160 from right to left in FIG. 8. Once second end 172 of bag support rod 160 passes arcuate edge 173 of horizontal leg 164 of second mount 150, second end 172 of bag support rod 160 becomes seated between arcuate edge 173 of horizontal leg 164 of second mount 150 and horizontal leg 118 of bracket 114 and is biased against inner face 168 of vertical leg 166 of second mount 150 by spring 180 in the second, bag retaining position, FIG. 7.

In order to return forward bag support 144 to the first, bag release position, FIGS. 6, 9 and 12, forward bag support 144 is rotated clockwise in FIGS. 4-7 about the axis of central portion 178 of bag support rod 160. In order to facilitate clockwise rotation of forward bag support 144, it is contemplated for a user to pull forward bag support 144 from left to right in FIG. 8 against the bias of spring 180. As forward bag support 144 is rotated clockwise in FIGS. 4-7, second end 172 of bag support rod 160 engages arcuate edge 173 of horizontal leg 164 of second mount 150 and is moved from left to right in FIG. 8 against the bias of spring 180. Thereafter, second end 172 of bag support rod 160 engages and slides along terminal end 176 of horizontal leg 164 of second mount 150 against the bias of spring 180, FIGS. 10 and 13. As forward bag support 144 continues being rotated clockwise in FIGS. 4-7, second end 172 of bag support rod 160 engages and slides along angled edge 174 of horizontal leg 164 of second mount 150. It can be appreciated that spring 180 urges bag support rod 160 from right to left in FIG. 8. Once second end 172 of bag support rod 160 passes angled edge 172 of horizontal leg 164 of second mount 150, second end 172 of bag support rod 160 becomes seated between angled edge 174 of horizontal leg 164 of second mount 150 and horizontal leg 118 of bracket 114 and is biased against inner face 168 of vertical leg 166 of second mount 150 by spring 180 in the first, bag release position, FIGS. 6, 9 and 12.

Figure 4:
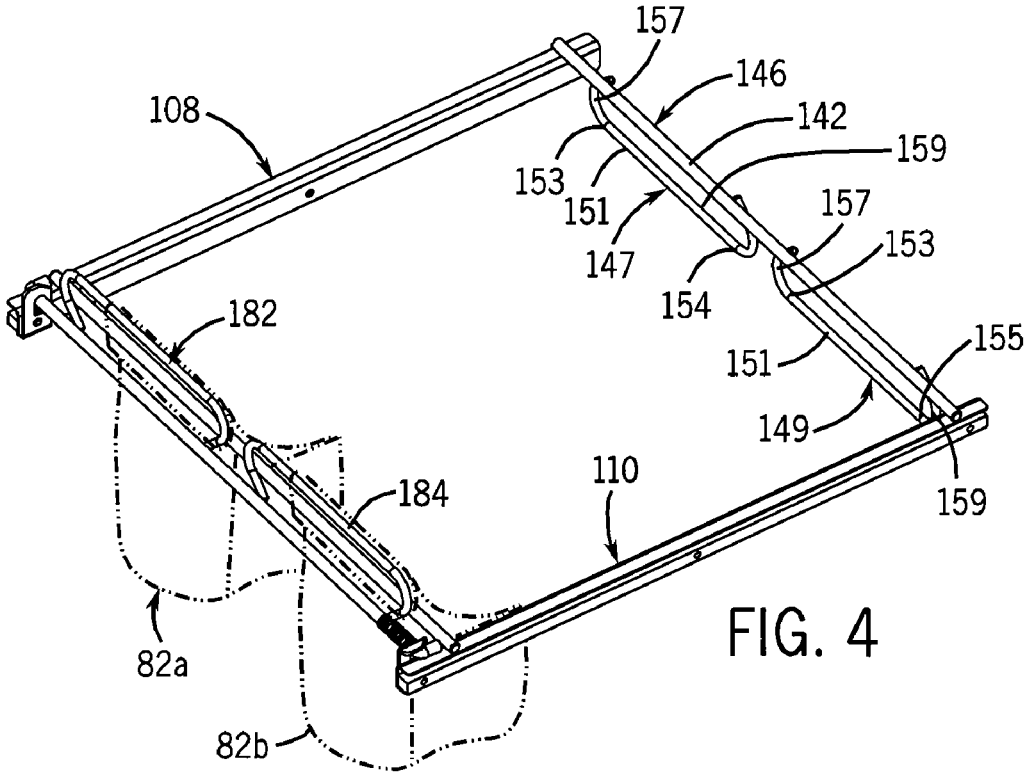
FIG. 4 is an isometric view of a bag holding slide for the recycling center of the present invention with a cinching mechanism in a non-cinching position.
Figure 5:
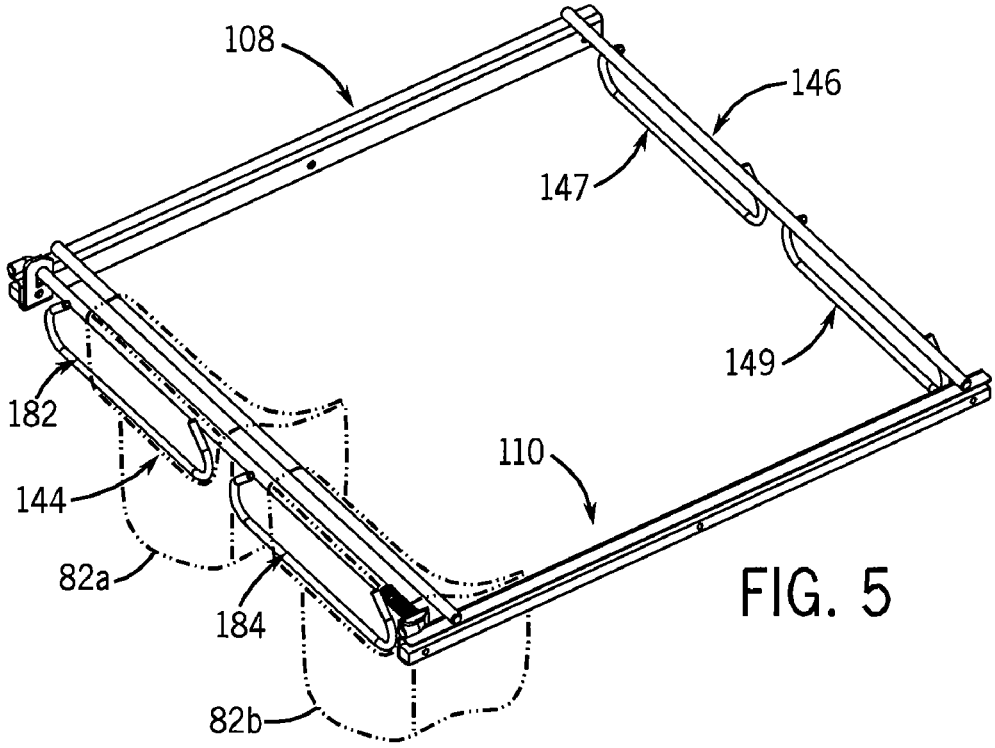
FIG. 5 is an isometric view of the bag holding slide for the recycling center of the present invention with a cinching mechanism in a cinching position.

In operation, forward bag support 144 is rotated to the first, bag release position, FIGS. 4 and 6. Bags 82*a* and 82*b*, preferably transparent, are provided. As is conventional, bags 82*a* and 82*b* include closed bottom ends 202 and opposite open ends 204, FIGS. 1 and 2. Open ends 204 of bags 82*a* and 82*b* include openings 206 defined by upper peripheral edges 208. A first portion of the upper edge 208 of first bag 82*a* is pulled over rear rod 142 of rear bag support 146 and is wrapped around first bag retainer 147 of rear bag support 146 such that concave portions 157 and 159 of first bag retainer 147 retains bag 82*a* thereon. A second portion of the upper edge 208 of bag 82*a* is pulled over forward rod 140 and is wrapped around first bag retainer 182 of forward bag support 144 such that concave portions 196 and 198 of first bag retainer 182 retains bag 82*a* thereon. Similarly, a first portion of the upper edge 208 of second bag 82*b* is pulled over rear rod 142 of rear bag support 146 and is wrapped around second bag retainer 149 of rear bag support 146 such that concave portions 157 and 159 of second bag retainer 149 retains bag 82*b* thereon. A second portion of the upper edge 208 of bag 82*b* is pulled over forward rod 140 and is wrapped around second bag retainer 184 of forward bag support 144 such that concave portions 196 and 198 of second bag retainer 184 retains bag 82*a* thereon. Thereafter, forward bag support 144 rotated from its first, bag release position, FIG. 6, to its second, bag retaining position, FIG. 7. As a result, bags 82*a*, 82*b* are retained in an open configuration.

With bags 82 mounted on forward bag support 144 and rear bag support 146, openings 206 in bags 82*a*, 82*b* are directed upwardly between first and second side rails 108 and 110, respectively, of bag slide 106. Thereafter, bag slide 106 is slid towards its retracted position such that such that opening 206 in bag 82*a* is directed at and in axial alignment with generally circular apertures 76 extending through upper panel 72. Likewise, opening 206 in bag 82*b* is directed at and in axial alignment with oblong aperture 77 through upper panel 72. As described, a first type of item to be recycled, e.g., plastic, may be deposited in either opening 76 in upper panel 72 of recycling center 10 so as to be received within bag 82*a*. A second type of item to be recycled, e.g., paper, may be deposited in opening 77 in upper panel 72 of recycling center 10 so as to be received within bag 82*b*.

Once bags 82*a*, 82*b* have been filed, it is contemplated to open door 84 and return slide bag slide 106 to its extended position. Thereafter, forward bag support 144 is returned to its first, bag release position, FIG. 6, so as to allow bags 82*a*, 82*b* to be removed from forward and rear bag supports 144 and 146, respectively. Once bags 82*a*, 82*b* have been removed, new bags 82*a*, 82*b* may be installed, as heretofore described.

It can be appreciated due to the modular nature of the present design, multiple recycling centers may be positioned adjacent one another and interconnected. In addition, it is contemplated for rear bag support 146 to be identical in structure to forward bag support 144, if so desired. Further, it can be appreciated that the openings 76, 77 in upper panel 72 of recycling center 10 may have any desired configuration. By way of example, referring to FIG. 1, openings 76 in upper panel 72 of recycling center 10 may take the form of elongated slots adapted for receiving sheets of paper therethrough. Additionally, it is contemplated for forward bag support 144 and rear bag support 146 to include additional bag retainers axially spaced along bag support rod 160 of forward bag support 144 and along rear rod 142 of rear bag support 146. As a result, multiple bags may be mounted on bag slide 106. Finally, it can be appreciated that first and second side panels 50 and 64 may be fabricated from a solid material, a mesh material or a transparent material. It can be appreciated that by fabricating first and second side panels 50 and 64 from a transparent or mesh material will allow for the simple and easy inspection of the interior of recycling center 10.

Various modes of carrying out the invention are contemplated as being within the scope of the following claims particularly pointing out and distinctly claiming the subject matter which is regarded as the invention.

The invention claimed is:

1. A bag support, comprising:

a first bar extending along a first axis;

a second bar extending along a second axis generally parallel to the first axis;

a first support having a first end operatively connected to the first bar and a second end operatively connected to the second bar;

a first bag retainer extending from the first bar for receiving a first portion of an upper end of a first bag thereon, the first bar being pivotable about the first axis such that first bag retainer moves between a first position and a second retaining position for supporting the first bag in an open configuration, wherein an outer end of the first bag retainer, when the first bag retainer is at the second retaining position, extends along a first horizontal plane that is below a second horizontal plane of the first support and wherein the outer end of the first bag retainer maintains engagement with the upper end of the first bag when pivoting from the first position to the second retaining position; and a biasing structure for urging the first bar towards a retaining position.

2. The bag support of claim 1 further comprising a second bag retainer extending from the first bar for receiving a first portion of an upper end of a second bag thereon, the second bag retainer movable between a first position and a second retaining position for supporting the second bag in an open configuration.

3. The bag support of claim 1 further comprising a second support having first end operatively connected to the first bar and a second end operatively connected to the second bar.

4. The bag support of claim 1 further comprising a second bag retainer extending from the second bar for receiving a second portion of the upper end of the first bag thereon.

5. The bag support of claim 1 wherein a first end of the first bag retainer is generally C-shaped and a second end of the first retainer is generally C-shaped.

6. The bag support of claim 1 wherein the first bag retainer extending from the first bar is one of a plurality of bag retainers extending from the first bar.

7. A bag support, comprising:

a first bar extending along a first axis and including a first bag retainer extending therefrom, the first bag retainer pivotable between a first position and a second retaining position for supporting a first bag in an open configuration, and wherein the first bag retainer is pivotable between the first position and the second retaining position while engaged with the first bag; and a second bar extending along a second axis generally parallel to the first axis and including a first bag retainer extending therefrom, the first bag retainer of the second bar supporting an upper portion of the first bag in the open configuration, wherein the first bar is movable along the first axis between a first retaining position wherein the first bag retainer is maintained in a user desired position and a second position wherein the first bag retainer is movable between the first and second positions

8. A bag support, comprising:

a first bar extending along a first axis;

a second bar extending along a second axis generally parallel to the first axis;

a first support having a first end operatively connected to the first bar and a second end operatively connected to the second bar; and a first bag retainer extending from the first bar for receiving a first portion of an upper end of a first bag thereon, the first bar being pivotable such that first bag retainer moves between a first position and a second retaining position for supporting the first bag in an open configuration, wherein an outer end of the first bag retainer, when the first bag retainer is at the second retaining position, extends along a first horizontal plane that is below a second horizontal plane of the first support and wherein the outer end of the first bag retainer maintains engagement with the upper end of the first bag when pivoting from the first position to the second retaining position, wherein the first bar is movable along the first axis between a first retaining position wherein the first bag retainer is maintained in a user desired position and a second position wherein the first bar is pivotable.

9. The bag support of claim 8, further comprising a biasing structure for urging the first bar towards the retaining position.

* * * * *